United States Patent [19]

Giacomazzi et al.

[11] Patent Number: 4,993,225

[45] Date of Patent: Feb. 19, 1991

[54] TWO CYCLE ENGINE VAPOR EMISSION CONTROL

[75] Inventors: Roy A. Giacomazzi; Mark G. Kosowski, both of Rochester Hills; Steven D. Stiles, Clarkston; Jeffrey S. Stueven, Auburn Hills, all of Mich.

[73] Assignee: General Motors Corporation, Detroit, Mich.

[21] Appl. No.: 369,594

[22] Filed: Jun. 21, 1989

[51] Int. Cl.[5] ..... F01N 3/28

[52] U.S. Cl. ..... 60/283

[58] Field of Search ..... 60/274, 283, 288

[56] References Cited

U.S. PATENT DOCUMENTS

| | | | |
|---|---|---|---|
| 3,618,314 | 11/1971 | Krebs | 60/283 |
| 4,070,828 | 1/1978 | Barres . | |
| 4,304,207 | 12/1981 | Aihara | 60/279 |
| 4,766,854 | 8/1988 | Riese . | |
| 4,862,689 | 9/1989 | Duret | 60/288 |

*Primary Examiner*—Douglas Hart

*Attorney, Agent, or Firm*—Robert J. Outland

[57] ABSTRACT

An emission system especially for controlling evaporative emissions from the fuel system of a two cycle engine having a split exhaust wherein a combustor is provided to burn fuel vapor mixed with scavenging air exhausted from the engine and the combustor exhaust may be mixed with the engine blowdown gas for further treatment in a catalytic device or other treatment means. Additional control features are disclosed.

5 Claims, 1 Drawing Sheet

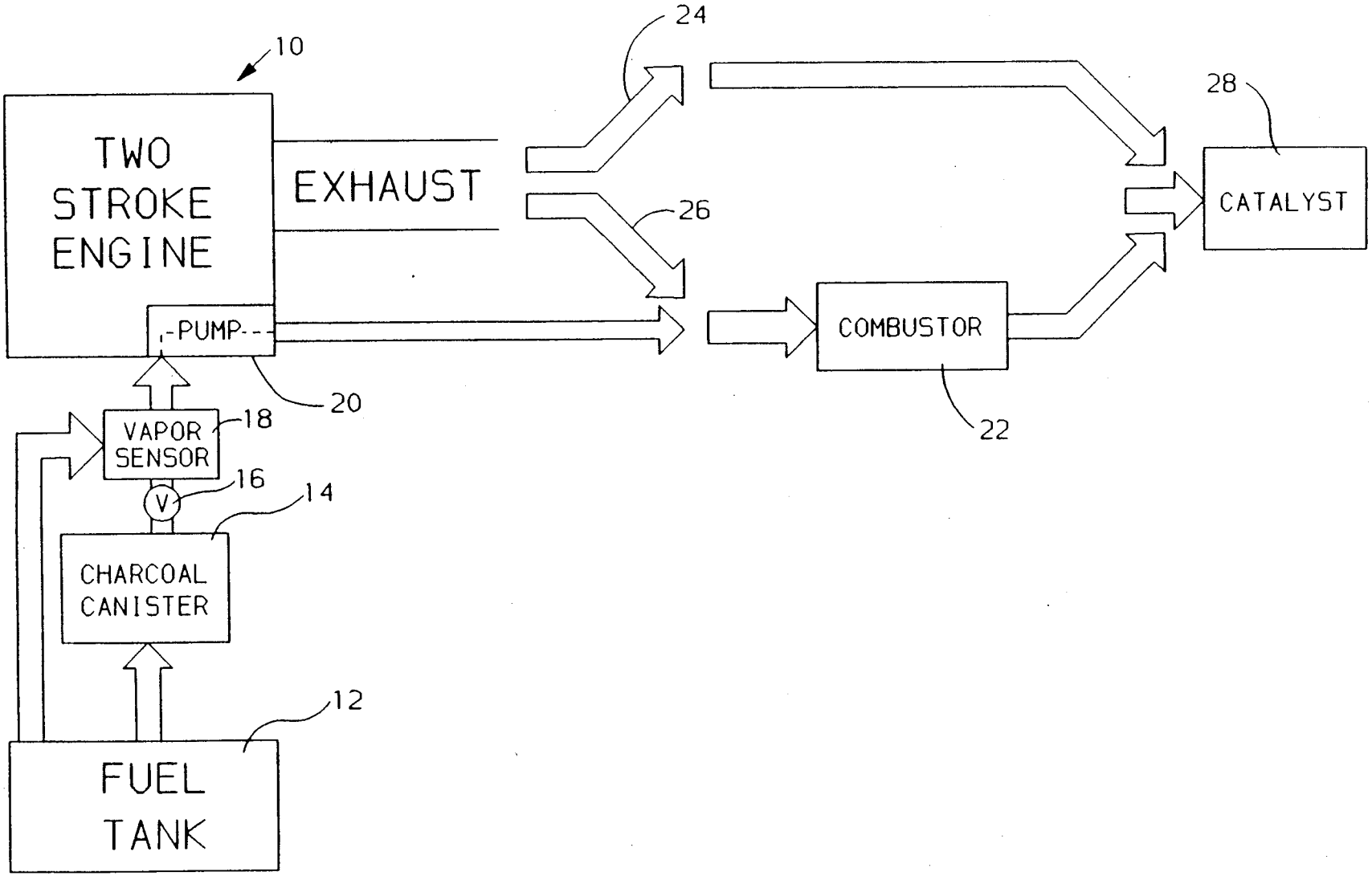
10
TWO STROKE ENGINE
EXHAUST
24
26
PUMP
20
VAPOR SENSOR
18
16
V
CHARCOAL CANISTER
14
FUEL TANK
12
COMBUSTOR
22
CATALYST
28

TWO CYCLE ENGINE VAPOR EMISSION CONTROL

TECHNICAL FIELD

This invention relates to emission control systems and, particularly, to such a system in combination with a two stroke cycle engine and a source of fuel vapor. A two stroke cycle engine may alternatively be referred to as a two stroke engine or a two cycle engine.

BACKGROUND

It is known in the art relating to four stroke cycle engines, such as for automobiles, to purge evaporative emissions from a fuel source by feeding them into the engine intake manifold to be burned in the cylinders. However in a two stroke cycle engine scavenging losses causing a carryover of scavenging air to the exhaust before burning could increase the fuel vapor in the exhaust and increase tailpipe emissions.

SUMMARY OF THE INVENTION

The present invention provides a method and system for purging evaporative emissions using a combustor. This application is especially useful in conjunction with a two stroke (or two cycle) engine.

In a two stroke application, a valve located in the exhaust stream may be used to separate the blowdown phase from the scavenging losses. The blowdown portion of the exhaust preferably operates at an A/F ratio which is near stoichiometry and is connected directly to a downstream catalyst. The portion of the exhaust consisting of scavenging losses is mostly air and may be controlled by the exhaust valve to form a combustible mixture when combined with the fuel vapors out of a storage canister. This combustible mixture is directed into a combustor for burning.

Exhaust products exiting the combustor may be recombined with the blowdown phase and together directed into the catalyst to control emissions from both the engine and combustor. High temperatures associated with the combustor's exhaust products may help increase the temperature of the overall exhaust and help catalyst lightoff. This may be helpful in two stroke applications where low exhaust temperatures are typically encountered.

These and other features and advantages of the invention will be more fully understood from the following description of certain specific embodiments of the invention taken together with the accompanying drawings.

BRIEF DRAWING DESCRIPTION

The single drawing FIGURE is a schematic view illustrating an evaporative emission control system as applied to a two cycle engine in accordance with the invention.

DETAILED DESCRIPTION

Referring now to the drawing in detail, numeral 10 generally indicates a two stroke cycle (two cycle) internal combustion engine fueled with a vaporizable liquid fuel such as gasoline drawn from a fuel tank 12. Fuel is delivered from the tank to the engine 10 by means of any suitable fuel delivery system, not shown.

Fuel vapors emitted from the tank 12 are stored temporarily in a charcoal canister 14 or fed directly to a control valve 16 to which the canister outlet is also connected. A vapor sensor 18 is in the line connecting the valve with a preferably engine mounted pump 20. The pump outlet connects with a combustor 22 in the engine exhaust system.

The engine exhaust includes splitter valve means, not shown, for separating the engine exhaust gases into a "blowdown" pipe 24 and a "scavenging" pipe 26. Exhaust splitter valve means of this type are shown for example in co-pending U.S. patent application Ser. No. 07/347,634 filed May 5, 1989 and assigned to the assignee of the present invention. The blowdown gases are fed through pipe 24 directly to the catalyst 28 of the catalytic converter. The scavenging portion of the exhaust on pipe 26 is mixed with vapor emissions from the pump 20 to form a combustible mixture prior to delivery to the combustor 22. The exhaust products from the combustor are preferably delivered to the catalyst 28 for further reaction and may be mixed with the blowdown gases as shown prior to entering the catalyst.

During engine operation, the scavenging losses flowing the through pipe 26 can be predicted based on engine speed and load. Consequently, the mass flow rate can be calculated since the losses are assumed to consist mostly of air. Demanding certain flammability limits within the combustor 22 dictates what A/F ratio band is acceptable in the fuel vapor mixture existing the canister 14. The vapor sensor 18 can be used to ensure the mixture satisfies the required A/F ratio band. When it detects the A/F ratio falling outside the lean limit, the canister 14 can be short circuited to the fuel tank where additional fuel vapors are located. This could be done via the valve 16. Finally, the engine may provide the needed pump 20 for vapor purging from the canister or fuel tank, whichever is required.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

The embodiments of the invention in which an exclusive property or privilege is claimed are defined as follows:

1. An emission control system in combination with a source of fuel vapor and a two cycle engine of the type having exhaust splitter means that separate exhaust gas into relatively fuel rich exhaust blowdown gas discharged through a first outlet and relatively fuel lean scavenging air discharged through a second outlet, said emission control system comprising a combustor for burning evaporative emissions from the the fuel vapor source, exhaust treatment means for treating exhaust gases from the engine and combustor, first means connecting the first outlet with the treatment means for conducting exhaust blowdown gas directly to the treatment means, second means connecting the second outlet with the combustor for conducting scavenging air to the treatment means for use in burning fuel vapor, and third means connecting the fuel vapor source with the combustor for conducting fuel vapor to the combustor for burning.

2. An emission control system as in claim 1 and further including fourth means connecting the combustor with the treatment means for conducting combustor exhaust gas to the treatment means.

3. An emission control system as in claim 1 and further including pump means in the third means for assisting delivery of the fuel vapor to the combustor.

4. An emission control system as in claim 1 wherein the fuel vapor source includes a fuel tank and control means are provided in the third means for controlling the delivery of fuel vapors to the combustor for maintaining a desired air/fuel ratio range.

5. An emission control system as in claim 1 wherein the fuel vapor source includes a fuel tank and control means are provided in the third means for controlling the delivery of fuel vapors to the combustor for maintaining a desired air/fuel ratio range, the system further including pump means in the third means for assisting delivery of the fuel vapor to the combustor, and fourth means connecting the combustor with the treatment means for conducting combustor exhaust gas to the treatment means.

* * * * *